US005813547A

United States Patent [19]

Rice

[11] Patent Number: 5,813,547

[45] Date of Patent: Sep. 29, 1998

[54] CLOTHING ACCESSORIES STORAGE RACK

[76] Inventor: Sherrie D. Rice, 831 Pinebrook Ct., Alpharetta, Ga. 30201

[21] Appl. No.: 790,684

[22] Filed: Jan. 28, 1997

[51] Int. Cl.[6] ..... A47F 5/025

[52] U.S. Cl. ..... 211/34; 211/37; 211/122; 312/134

[58] Field of Search ..... 211/37, 34, 1.52, 211/1.57, 122, 181.1, 163; 312/267, 268, 202, 200, 132, 134, 135; D6/315, 322

[56] References Cited

U.S. PATENT DOCUMENTS

| | | | |
|---|---|---|---|
| 2,880,878 | 4/1959 | Collette | 312/134 X |
| 2,980,258 | 4/1961 | Collette | 211/122 X |
| 3,331,513 | 7/1967 | Cappelli | 211/34 |
| 4,008,807 | 2/1977 | Phillips | 211/34 |
| 4,036,367 | 7/1977 | Stambaugh et al. | 211/37 |
| 4,422,554 | 12/1983 | Lichti | 211/122 X |
| 4,858,772 | 8/1989 | Phillipson | 211/34 |
| 5,033,626 | 7/1991 | Platti | 211/37 |
| 5,050,746 | 9/1991 | Frankel | 211/34 |
| 5,065,871 | 11/1991 | Chan | 211/37 |
| 5,076,442 | 12/1991 | Hakeem | 211/34 |
| 5,127,528 | 7/1992 | Cone | 211/34 |
| 5,207,335 | 5/1993 | Voelz | 211/122 |
| 5,305,890 | 4/1994 | Ishikawa | 312/267 X |
| 5,423,435 | 6/1995 | Pollard et al. | 211/37 |
| 5,533,632 | 7/1996 | Patterson et al. | 211/1.57 X |

FOREIGN PATENT DOCUMENTS

| | | | |
|---|---|---|---|
| 25109 | of 1904 | United Kingdom | 211/34 |

*Primary Examiner*—Peter M. Cuomo
*Assistant Examiner*—James O. Hansen
*Attorney, Agent, or Firm*—Kennedy, Davis & Kennedy

[57] ABSTRACT

A rotatable shoe rack for visible and readily accessible storage of a plurality of clothing accessories such as shoes, ties, scarves and belts, comprising a pair of opposing base plates, having slotted channels which receive flexible belts that define a plurality of sockets. Respective distal ends of elongate support members engage the sockets, whereby the support members extend between the base plates. Each support member includes a plurality of spaced-apart cross-arms to which a shoe receivers are attached. Shoes, being placed on the shoe receivers, are selectively viewed for retrieval, by causing the belts to move along the channels. Arms extend from the support member for receiving ties, scarves, and belts.

19 Claims, 6 Drawing Sheets

CLOTHING ACCESSORIES STORAGE RACK

TECHNICAL FIELD

The present invention relates to apparatus for storing clothing accessories. More particularly, the present invention relates to rotatable racks for storing clothing accessories, such as shoes, ties, scarves, belts and the like, accessibly in closet spaces.

BACKGROUND OF THE INVENTION

Clothing accessories, such as shoes, ties, scarves, and belts are not only utilitarian articles of clothing, but also are fashion accessories for stylish dressing. It is not uncommon for men and women to accumulate a large number of such clothing accessories for use with clothes dressing. For example, shoes are commonly available for men and women in a range of shapes, sizes, and colors. The pairs of shoes are stored, typically in clothes closets, for selection and wear. For persons with a limited number of shoes, storing the shoes on the floor of clothes closets allows access for viewing, selection, as well as storage of shoes. The shoes can be lined up against a wall. The drawback to such storage techniques is the limited floor space for a larger number of shoes and the tendency of closet organization to become cluttered and disorganized.

Over the years, different apparatus for storing shoes have been developed to overcome the seeming inevitable chaotic congregation of shoes on the floor of a closet. These devices include shelf devices, shoe racks, and shoe trees. Shelves are typically narrow in width, shallow in depth, and closely spaced apart in tall frames for holding a number of pairs of shoes. However, it may be difficult to see the shoes in the narrow shelves for viewing and selection of an appropriate pair to wear. Shoe racks are typically free-standing, low-rise shelves placed on the floor of a closet. These types of devices are often difficult to access as the shoes are stored below the typical level of clothing hung on clothes rods, typically disposed below a shelf, in a closet. The clothes hanging from the rod however tends to restricts visibility and access to the shoes on the shoe rack. Often it is necessary to stoop and bend at awkward angles to view and retrieve a selected pair of shoes for wearing. Vertical shoe racks have been developed which reduce some of the difficulties associated with these other devices for storing shoes. Wire frame shoe racks having a plurality of upside-down U-shaped receivers are available for mounting on the back of doors. Other shoe racks mount to central columns for rotational display of shoes. Another device is a bag that hangs from a closet rod. The bag has a number of pockets for receiving shoes. These however have not proven entirely satisfactory for storing shoes for viewing and selection while efficiently using space.

Accordingly, it is seen that a need exists in the art for an improved storage rack which readily accessible for the viewing and selection of clothing accessories, including shoes.

SUMMARY OF THE INVENTION

The present invention meets a need in the art for readily accessible storage and viewing of a plurality of shoes by providing an elongate rotatable rack that stores a plurality of shoes in a clothes closet. The shoe rack comprises a pair of opposing base plates. Each base plate has a slotted channel extending around a perimeter portion on one surface. The base plates are spaced-apart and disposed with facing surfaces. The slotted channel in the base plate is defined by pair of parallel, spaced-apart L-shaped flanges that extend from the base plate. The flanges define a gap therebetween for receiving end portions of elongate support members. A flexible belt is disposed within each of the slotted channels. The belts each define a plurality of substantially equally spaced-apart sockets which are in alignment with the gap between the flanges. A plurality of elongate support members extend between the pair of opposing base plates. The respective distal ends of each of the elongate support members engage one of the sockets of each of the belts, whereby the support members extend between the base plates. Each elongate support member includes a plurality of spaced-apart cross-arms. A pair of substantially U-shaped shoe receivers attach to each of the cross-arms. Each shoe receiver attaches at a first end to a respective distal portion of the cross-arm and at a second end to the elongate member, whereby a shoe, being inverted, is slidingly received on one of said shoe receivers. The pairs of shoes, being placed on the shoe receivers, are selectively viewed for retrieval by causing the belts to move along the channels and thereby carry the support members with the shoes to a selection and retrieval position in the closet space.

DETAILED DESCRIPTION OF THE PREFERRED EMBODIMENTS

Figure 1:
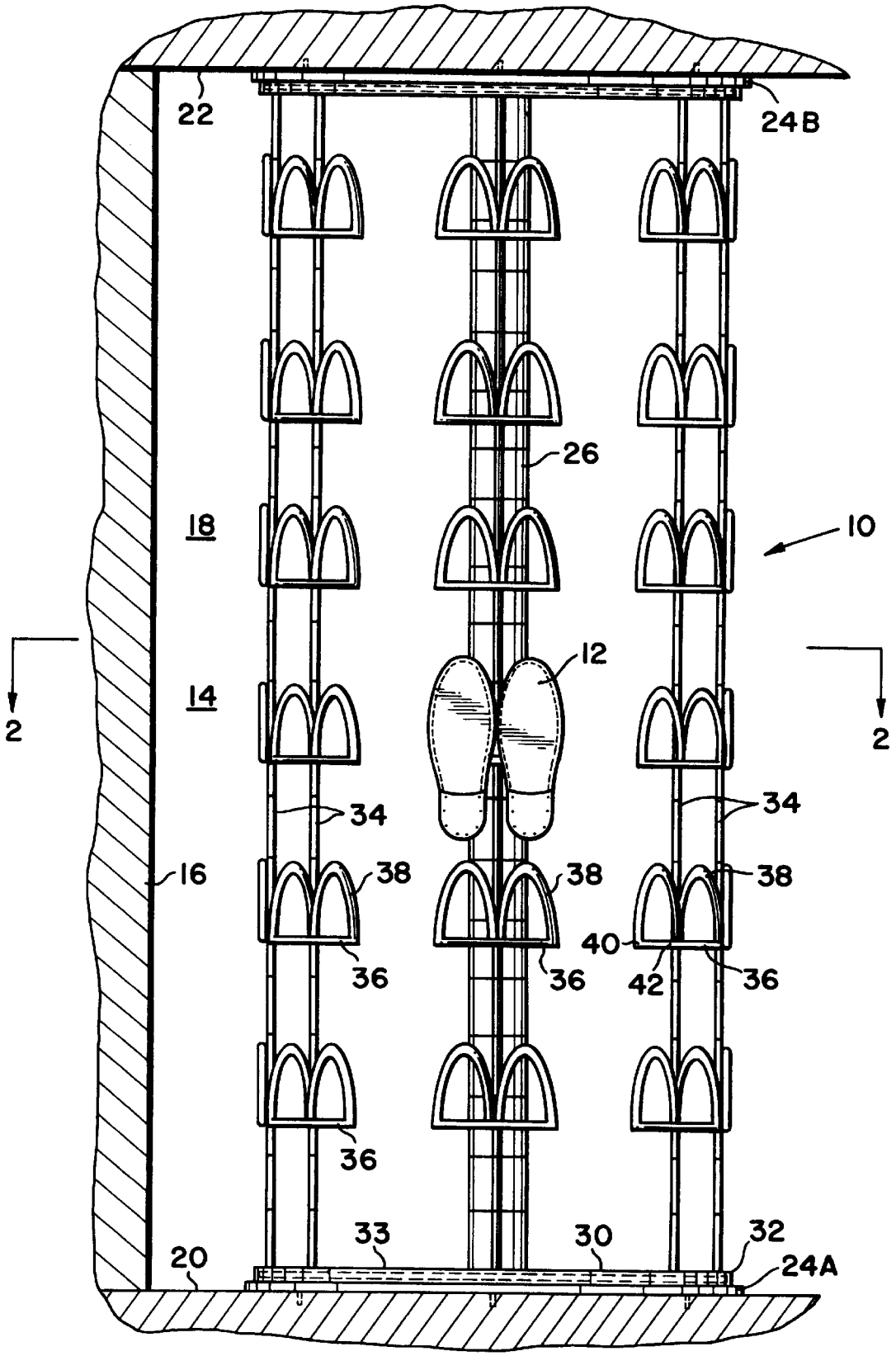
FIG. 1 is side view of an embodiment of a shoe rack according to the present invention for holding a plurality of shoes in closet space.
Figure 2:
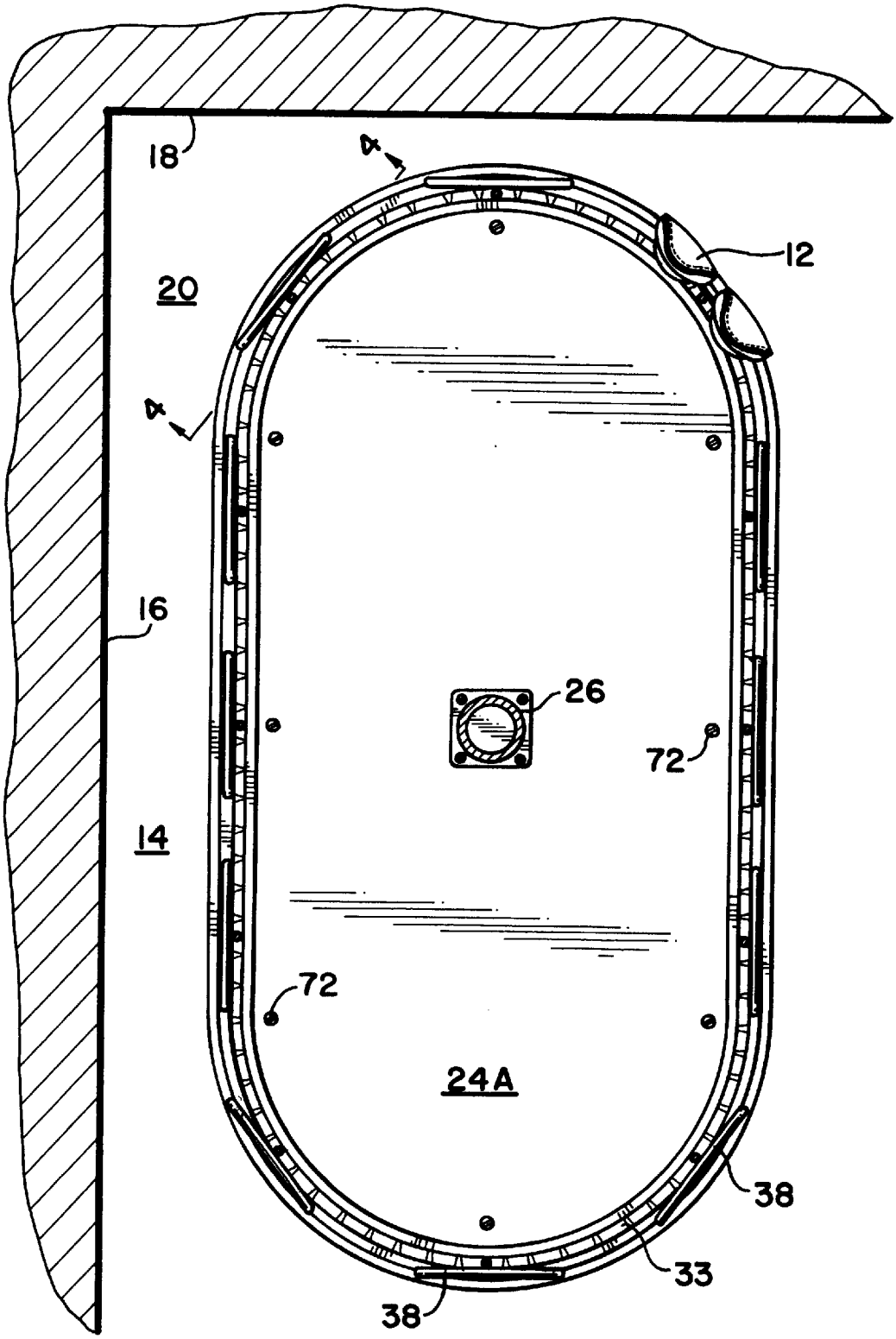
FIG. 2 is a top cross-sectional view of the shoe rack illustrated in FIG. 1.

Referring now in more detail to the drawings, in which like numerals indicate like parts throughout the several views, FIG. 1 illustrates a side view of an embodiment of a shoe rack 10 according to the present invention for holding a plurality of shoes 12 in a closet space generally 14 defined by intersecting side walls 16 and 18 with a floor 20 and a ceiling 22, as best illustrate in top plan view in FIG. 2. The shoe rack 10 provides a pair of oval base plates 24 which are disposed in aligned, spaced-apart relation in the closet space 14. In the illustrated embodiment, one base plate 24*a* sits on the floor 20 of the closet; the other of the pair of base plates 24*b* is disposed adjacent the ceiling 22. The base plates 24 connect to respective distal ends of a central post 26 which provides support for the shoe rack 10. In the illustrated embodiment, the base plates 24 connect to the floor 20 and the ceiling 24 with conventional screws. It may be appreciated that the base plate 24*b* can be secured to a lower surface of a shelf in the closet space 14. In an alternate embodiment, the shoe rack 10 is free-standing and disposed within the closet space 14 for holding shoes. In another alternate embodiment, the central post includes a telescoping pair of members with a spring biasing the members apart. The shoe rack accordingly is received in the closet space between the floor and a lower surface of a shelf in the closet, with the spring forcibly holding the rack in position.

Each of the base plates 24 includes a channel 30 that extends around the perimeter on a first surface 32 of the baseplate. The channel 30 receives a flexible belt 33 (discussed below). A plurality of elongate support members 34 connect to and extend between the respective belts in the channels of the baseplates 24*a* and 24*b*, as discussed below. A plurality of cross-arms 36 attach in spaced-apart relation along the length of the support member 34. A pair of shoe receivers 38 attach to each of the cross-arms 36. In the illustrated embodiment, in front plan view, the pair of shoe receivers 38 on each cross-arm 36 are symmetrical relative to the respective elongate support member 34 which supports the shoe receivers. Outer distal ends 40 of the U-shaped shoe receivers 38 connect to respective distal ends of the cross-arms 36; the inner distal ends 42 of the shoe receivers 38 connect to the respective support member 34. The spacing apart of the cross-arms is sufficient to accommodate the typically larger sizes of men's shoes; in an alternate embodiment, the spacing is closer together for use in holding typically smaller women's shoes and thereby also accommodate a greater number of shoes. The member 34 and the shoe receivers 38 may be made of stiff metal wires coated with a resistant covering.

Figure 3:
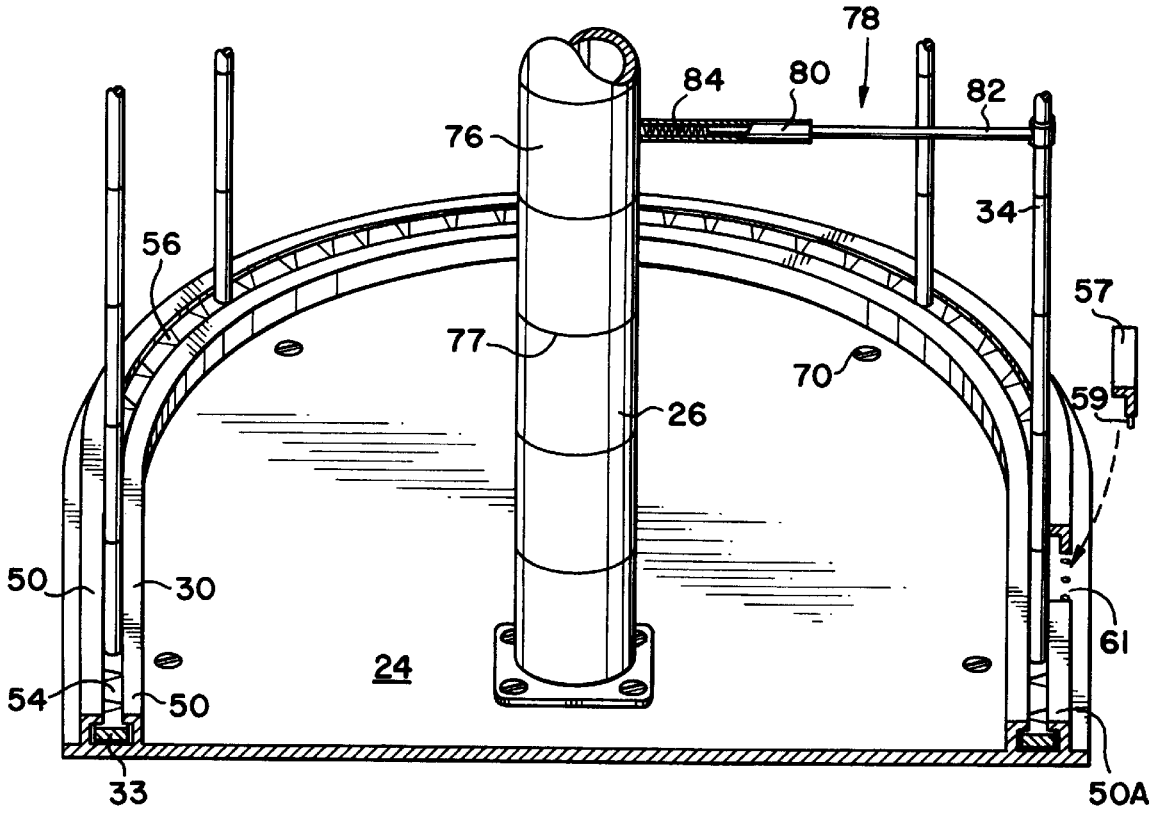
FIG. 3 is a perspective partial view of the lower portion of the shoe rack illustrated in FIG. 1.

FIG. 3 illustrates a perspective partial view of a lower portion of the shoe rack 10 to show features of the base plates 24 and the channels 30. The channel 30 is defined by a pair of flanges 50 that extend from the surface 32. The flanges 50 are preferably mirrored, facing L-shaped members extending from the base plate 24. In a preferred embodiment, the flanges 50 are molded integral with the base plate 24. The distal ends 52 of the flanges 34 are spaced-apart to define a gap 54 therebetween. In an alternate embodiment, the channel 30 is defined by a molded track substantially U-shaped in cross-sectional view as illustrated in FIG. 3. This separate channel is rigidly mounted to a base.

Figure 4:
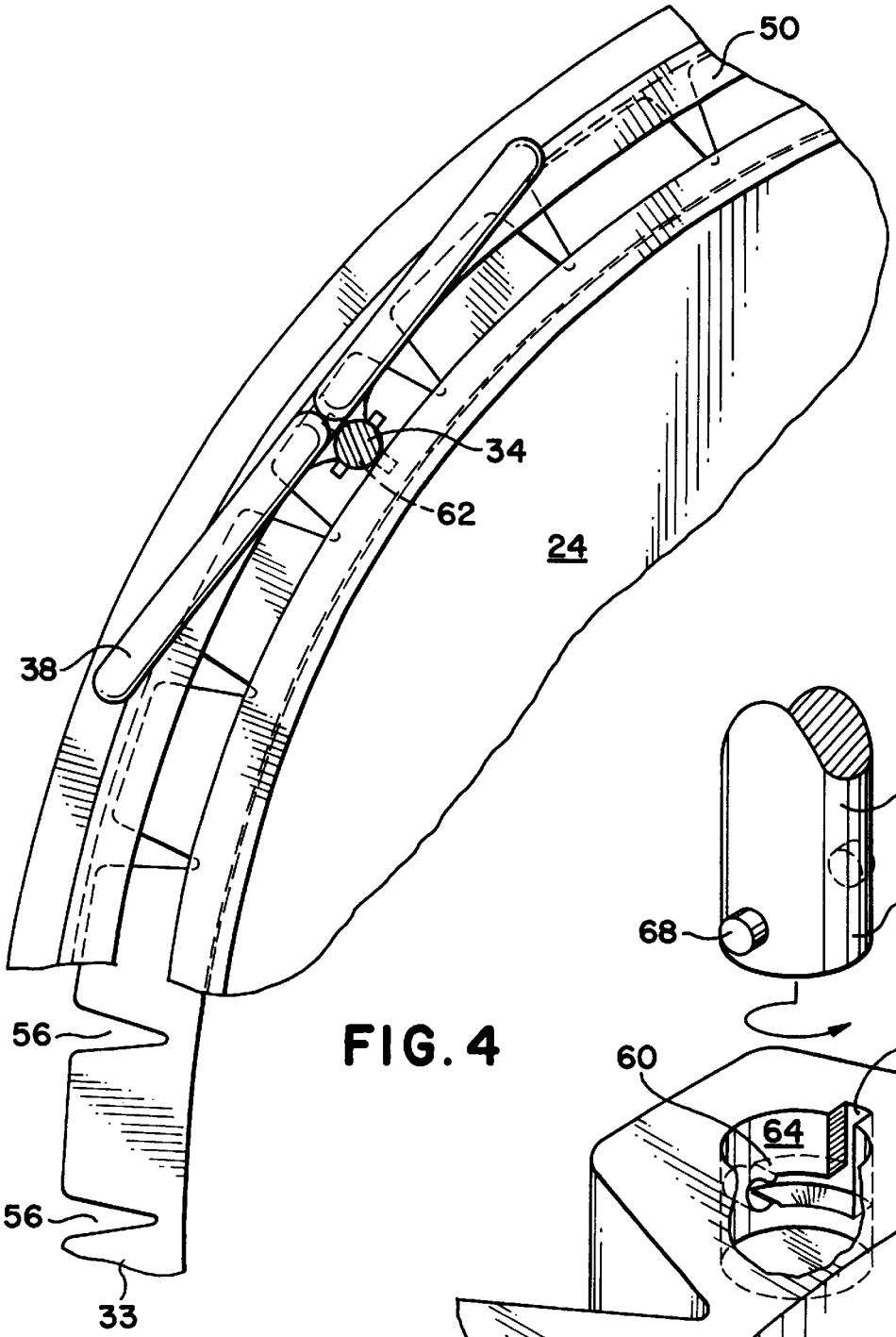
FIG. 4 is a top partial view of the lower portion of the rack illustrate features of the shoe rack shown in FIG. 1.

The channels 30 receive the flexible belt 33 which slidingly travels freely within the channel. The belt 33 is best illustrated in top partial view in FIG. 4 taken along lines 4—4 of FIG. 2. The belt 33 includes spaced-apart slots 56 which facilitate the flexibility of the belt in negotiating the arcuate portions of the channel 30 on the perimeter of the base plates 24. As shown in FIG. 3, a portion 57 of the flange 50*a* is detachably engaged to the base plate 24, whereby the belt 33 is then slidingly received within the channel 30. In the illustrated embodiment, a plurality of pins 59 extend downwardly from the portion 57 and engage respective openings 61 for engaging the portion 57 to the base plate 24. The belt 33 is preferably made of a low-friction material to facilitate sliding movement within the channel 30. The ends of the belt 33 are connected together, for example, with a link that overlaps the adjoined ends of the belt 33, to define a loop that travels in the channel 30. In an alternate embodiment, the distal ends of the belts 33 define mating tongue and groove terminal ends which engage to define the loop.

Figure 5:
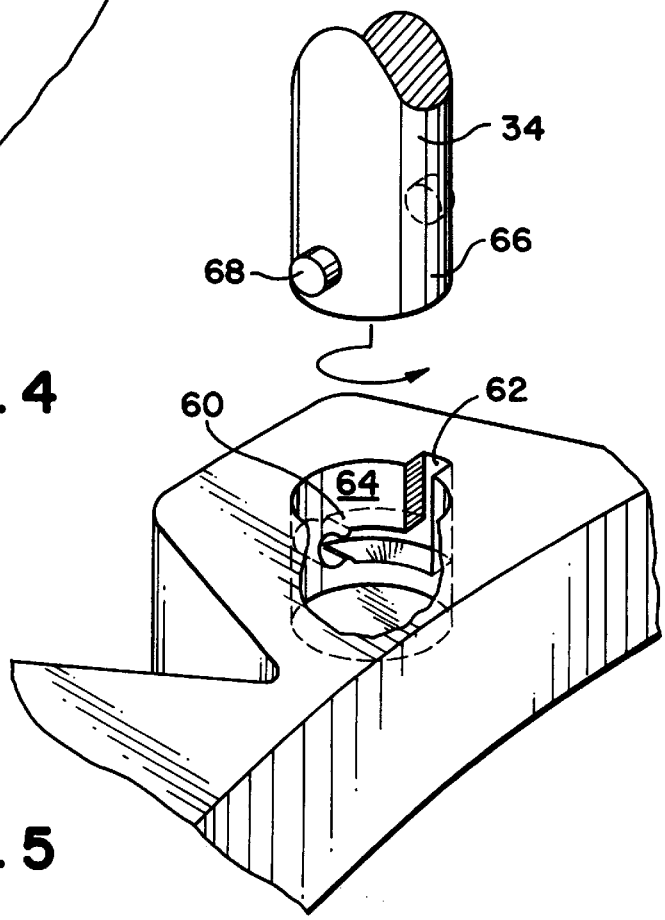
FIG. 5 is a perspective partial view of a track and elongate support member used in the shoe rack illustrate in FIG. 1.

The belts 33 further define a plurality of sockets 60 for receiving the distal ends of the elongate support members 34. FIG. 5 illustrates a perspective partial view of one of the support members 34 exploded from one of the sockets 60 in the belt 33. In the illustrated embodiment, each socket 60 defines a pair of L-shaped slots 62 in the side wall 64 of the socket. The distal ends 66 of the support members 34 include outwardly projecting pins 68. The pins 68 insert into the slots 62 when the distal end 66 is received in the socket 60. In an alternate embodiment, the members 34 do not include the pins 68 and the sockets 60 are holes without the slots 62. In that embodiment, the distal ends of the members 34 are force-fit into in the sockets 60 which grippingly engages the ends of the support members 34. In another alternate embodiment (not illustrated) the belt is defined by a conventional link chain having rollers and plates. In this embodiment, the distal ends of the members 34 extend through holes defined in the plates. The ends are threaded and securely connect to the plates with nuts.

As illustrated in FIG. 2, the base plates include a plurality of bores 70 which receive screws 72 for selectively securing the base plates 24 to the floor 22 and ceiling 24. With reference to FIG. 3, the central support post extends between the base plates 24*a* and 24*b*. In an alternate embodiment also illustrated in FIG. 3, the support post 26 includes at least one hub 76 which is freely rotatable between bushings 77 about the longitudinal axis of the support post. A plurality of telescopic arms 78 (one arm is illustrated in cut-away view in FIG. 3) extend radially from the hub 76. One of the arms 78 extends to each of the support members 34 for support. The arm 78 comprises a first member 80 which slidingly receives a radially distal inner end of the second member 82. The first member connects to the hub 76; the second member connects to one of the support members 34. A spring 84 connects to the hub 76 and the second member 82 and slightly biases the arm radially inward to facilitate the travel of the support members 34 about the base 24. The telescoping arms support the support arms 34 which carry the shoes on the shoe rack 10.

The shoe rack 10 of the present invention is operated for storing the plurality of shoes by disposing the base plates 24 in spaced-apart relation. The shoe rack 10 is assembled by inserting the belts 33 in the channels 30 of the base plates 24 by removing the side portion 57. The ends of the belts 33 are secured together, such as by a link member, to define an endless loop. The side portions 57 are secured to the channels 30. The central post 26 is secured to the top and bottom plates 24 with screws that connect a flange of the post with the base plates. The distal ends of the elongate support members 34 engage respective sockets 60 in the belts 33, and the rack is disposed in a corner space 14 of the clothes closet. In an alternate embodiment, the base plates 24 are secured to distal ends of the central support and the rack 10 placed free-standing in a closet space 14. In the illustrated embodiment, the base plates 24 with screws to the floor 20 and the ceiling 24.

The distal ends of the support members 34 are engaged in aligned sockets 60 in the belts 33 in the respective base plates 24. In the illustrated embodiment, the distal ends are received in the sockets 60 with the pins 68 engaged to the slots 62. The support members 34 are rotated to insert the pins 68 into the distal ends of the slots 62. A raised portion (not illustrated) near the distal end defines a stop to secure the support member end in place in the slot. In the embodiment in which the distal ends do not include the laterally-extending pins, the ends of the support members are force-fit into the sockets 60 which grippingly engage the ends.

Pairs of shoes 12 are placed on the shoe receivers 38. The shoes can be selectively arranged according to the needs of the person, for example, the arrangement may be by color, style, or purpose of the shoes. The shoe rack 10 is operated by pulling laterally on the elongate members 34 to cause the belts 33 to travel in the channels 30. This causes the members 34 to move around the perimeter of the base plates as the belts 33 travel in the channels 30. The support members 34 on the back side of the shoe rack (i.e., near the junction of the walls 16 and 18), are thereby moved from the back side to a front side for accessible placing pairs of shoes on the shoe receivers, and for viewing and retrieving of shoes from the shoe receivers of the shoe rack 10.

In an alternate embodiment, the shoe rack includes a motor mounted to the base plate 24*b*. The motor connects to a supply of current, such as batteries, for operating the motor. A drive gear is driven by the motor and operatively engaged to the belt 33 in the channel 30 of the base plate 24*b*. The motor is selectively operated by a switch mounted to a facing edge of the base plate 24*b*, whereby the operation of the motor causes the belt 33 within the channel 30 to move in order to rotating the members in the back portion of the shoe rack 10 to a forward position for selection and retrieval of shoes from the rack.

Figure 6:
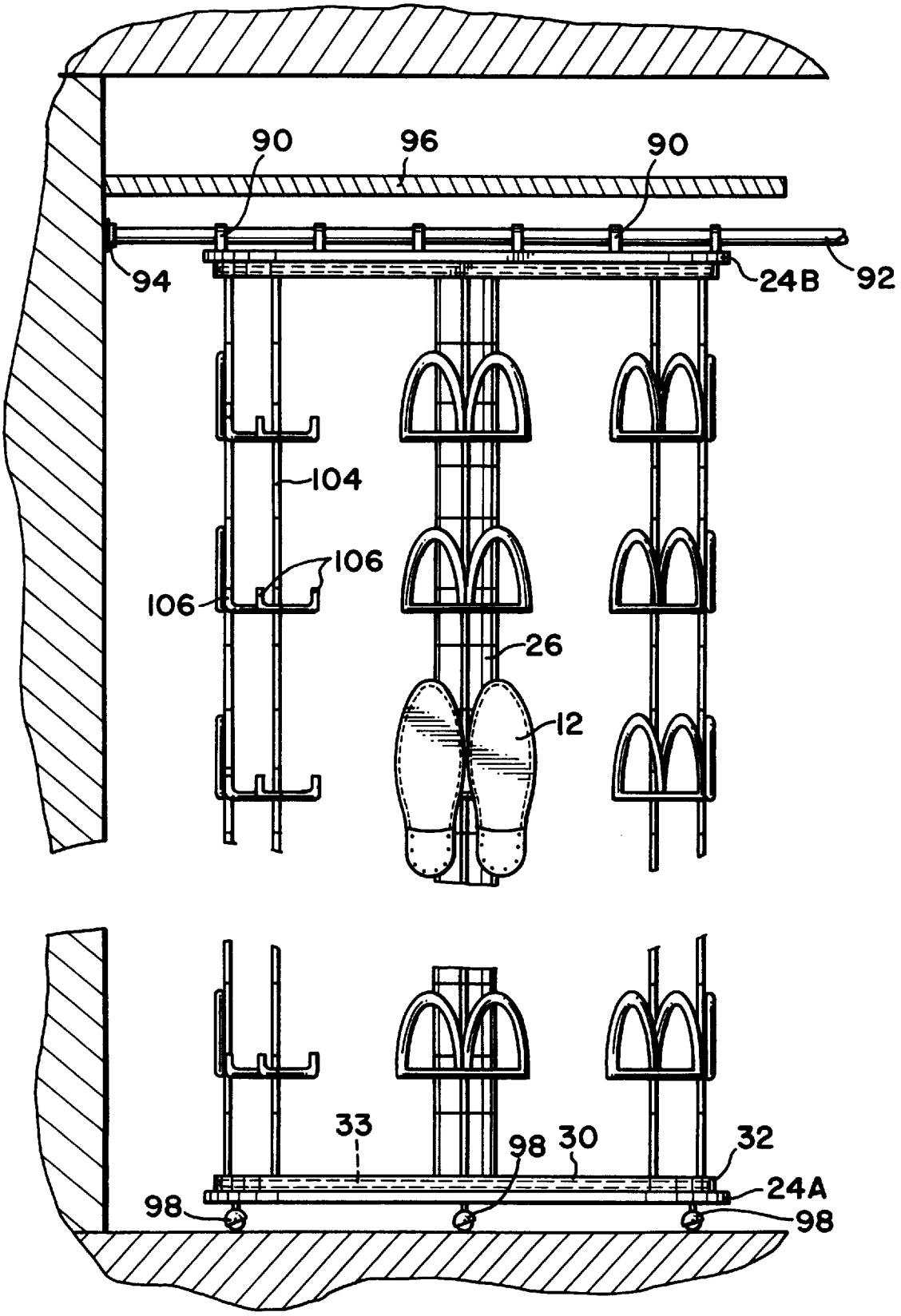
FIG. 6 is a side view of an alternate embodiment of the shoe rack illustrated in FIG. 1.
Figure 7:
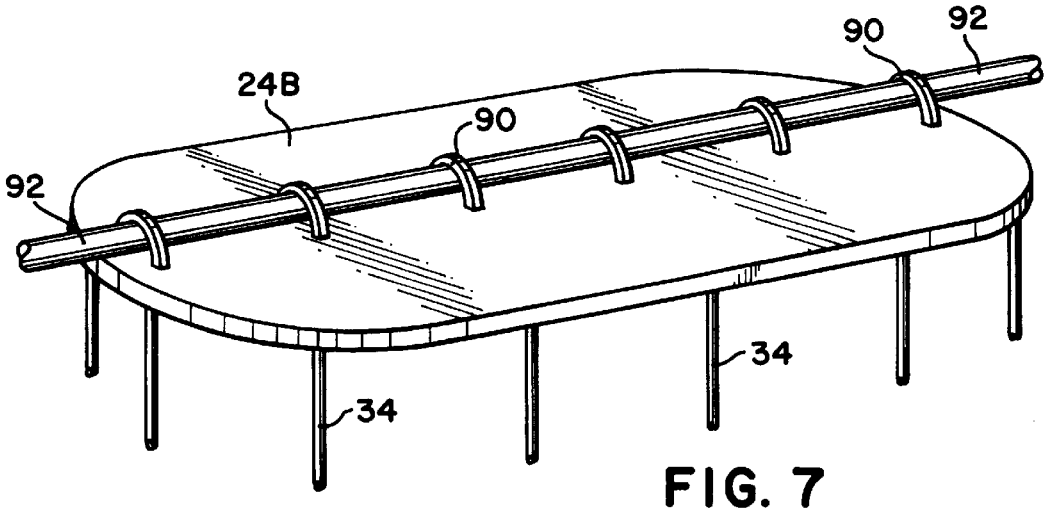
FIG. 7 is a perspective detailed view of the alternate embodiment of the shoe rack illustrated in FIG. 6.

FIG. 6 illustrates an alternative embodiment of the shoe rack 10. The base plate 24*b* includes a plurality of spaced-apart loops 90 that extend from a surface opposite the surface on which the channel 30 is defined, as best illustrated in perspective detailed view in FIG. 7. A clothes rod 92 is conventionally supported in brackets 94 attached to the closet walls and below a closet shelf 96. The clothes rod 92 extends through the loops 90, whereby the shoe rack 10 is suspended in a clothes closet 14 below the shelf 96 and between the clothes rod 92 and the floor 20.

In another alternate embodiment also illustrated in FIG. 6, the bottom base plate 24*a* engages wheels or casters 98 which permits the shoe rack 10 to roll easily for movement within the closet, for example, longitudinally on the clothes rod 92 as may be necessary.

Figure 8:
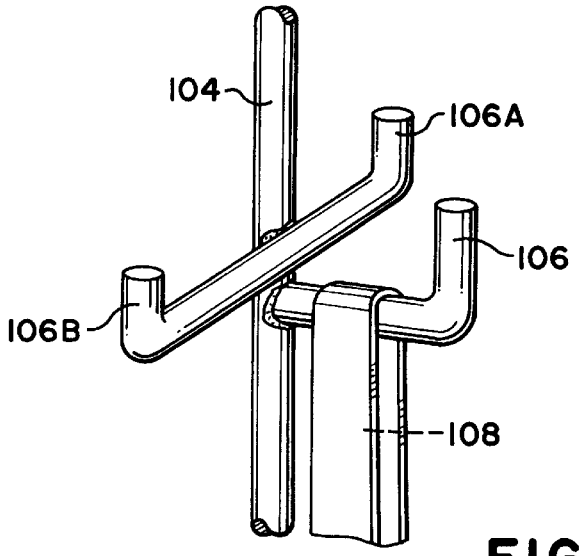
FIG. 8 is a perspective detailed view of a cross-arm adapted for holding ties, scarves, and belts in the shoe rack illustrated in FIG. 6.

FIG. 6 further illustrates an alternate embodiment 104 of the elongated support member 34 which is adapted to support a plurality of clothing accessories such as ties, scarves, and belts. The member 104 has a plurality of groups of three L-shaped arms 106 disposed at 90° angles to each other and extending laterally on the sides and outwardly of the member 34, as best illustrated in perpsective detailed view in FIG. 8. In the illustrated embodiment, each group has two arms 106*a* and 106*b* formed from a single member in which distal end portions are bent at an angle to define the two L-shaped arms. Clothing accessories, such as ties 108, loop over the arms 106. The clothes rack 10 can be custom assembled with a selected number of the members 34 for holding shoes and a selected number of the members 104 for ties, scarves, and the like.

Figure 9:
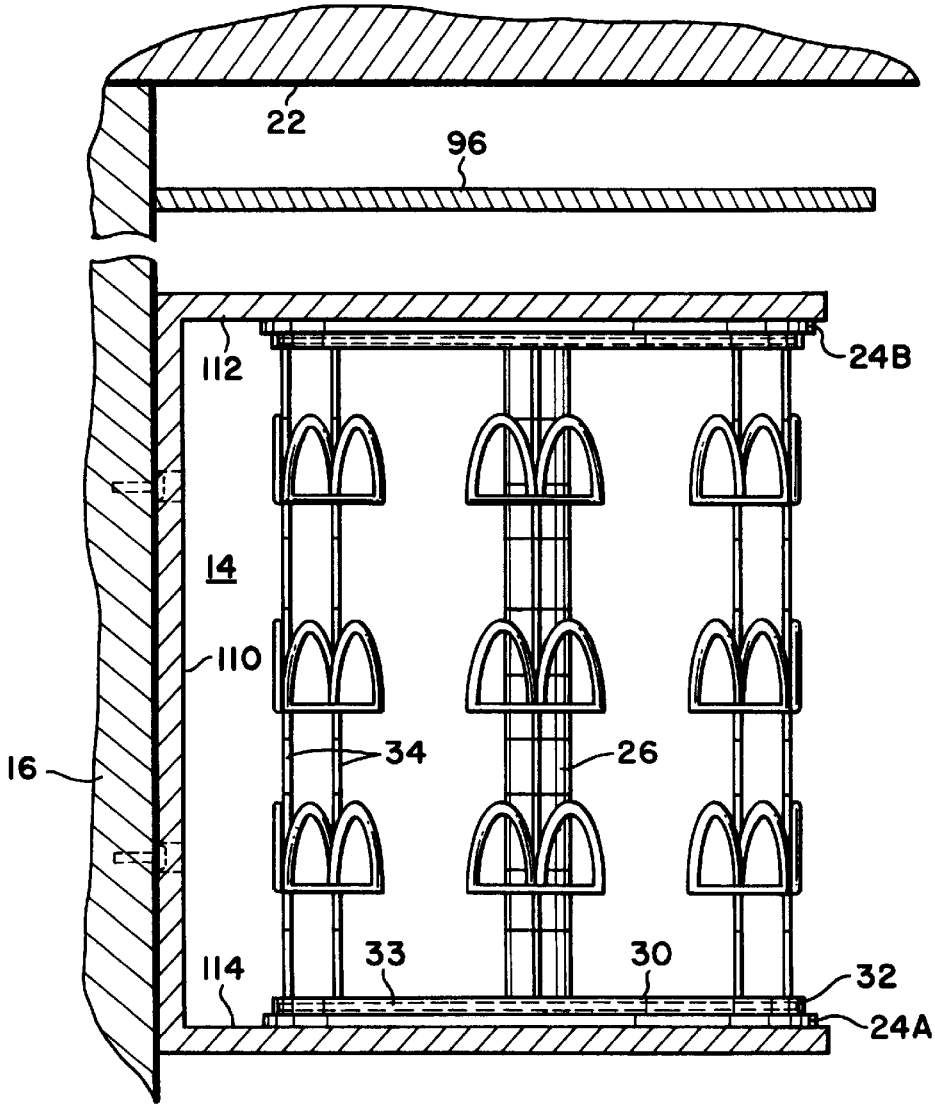
FIG. 9 is a side view of an alternate embodiment of the shoe rack.

FIG. 9 illustrates an alternate embodiment of the shoe rack 10 that mounts to the wall 16 with a C-shaped bracket 110. The bracket 110 has an upper member 112 and a lower member 114 that engage the plates 24. A sidemember 116 is preferably secured to the wall 16 with screws.

The shoe rack 10 accordingly allows for the compact storage of a large number of shoes, with the elliptical base plates received in the limited corner space 14 of a closet to facilitate use of the space for a number of pairs of shoes while providing easy and convenient access to shoes and other clothing accessories as well as the hanging clothes in the closet without undue clutter on a closet floor.

It is thus seen that the present invention provides a rotational rack for accessible viewing and selection of clothing accessories, such as shoes, ties, scarves, and belts, within a closet space. The principles, preferred embodiments, and modes of operation of the present invention have been described in the foregoing specification in detail with particular references to the preferred embodiments thereof. The invention is not to be construed as limited to the particular forms disclosed because these are regarded as illustrative rather than restrictive. Moreover, modifications, variations, and additions may be made thereto without departure from the spirit and scope of the invention as set forth in the following claims.

What is claimed is:

1. An elongate rotatable rack providing readily accessible storage of a plurality of shoes in a clothes closet, comprising:

a pair of opposing base plates, each having a slotted channel extending around the perimeter on respective facing surfaces of the pair of base plates;

a flexible belt disposed within each of the slotted channels and each of the belts defining a plurality of substantially equally spaced-apart sockets therein;

a plurality of elongate members extending between the pair of opposing base plates, each of said elongate members engaged at respective distal ends in one of the sockets of each of the belts, the slotted channel in the bases defining a gap for receiving therethrough an end portion of the elongate members;

a plurality of spaced-apart cross-arms attached to each of the elongate members;

a pair of shoe receivers attached to each cross-arm, each shoe receiver attached at a first end to a respective distal portion of the cross-arm and at a second end to the elongate member, whereby a shoe, being inverted, is slidingly received on one of said shoe receivers, whereby shoes, being placed on the shoe receivers, are selectively viewed for retrieval by causing the belts to move along the channels.

2. The rotatable rack as recited in claim 1, wherein the slotted channel is defined by a pair of parallel, spaced-apart L-shaped flanges extending from the base plate to define a gap between the distal ends of the flanges for receiving the end portions of the elongate members therebetween.

3. The rack as recited in claim 1, further comprising a central column extending between the pair of opposing base plates for support of the rack.

4. The rack as recited in claim 3, further comprising:

at least one hub rotatably mounted on said central support member; and a plurality of arms, each extending radially from said hub to one of said elongated members, for supporting said shoe rack.

5. The rack as recited in claim 4, wherein said arms comprise:

a first tube mounted to said hub; and a second tube connected at one end to a respective one of the elongate members and slidingly received at a radially distal inner end in the first tube, whereby said arms define a slidable telescoping tube.

6. The rack as recited in claim 5, wherein said arms further comprise a spring connected to said hub and to said inner end of said second tube, whereby said arms each define a telescoping tube biased radially inwardly.

7. The rack as recited in claim 1, further comprising support means for holding the rack in the closet.

8. The rack as recited in claim 7, wherein support means comprises a plurality of loops extending from an outer surface of the base plate for receiving an elongated rod mounted within a closet space, whereby the shoe rack is suspended from the elongated rod within the closet.

9. The rack as recited in claim 7, wherein support means comprises securing means for attaching said base plates to a floor surface and an upper surface such as a shelf or ceiling in the closet.

10. The rack as recited in claim 1, further comprising a plurality of wheels pivotally connected to a lower surface of a lower one of the base plates, whereby the rack is movable within the closet.

11. The rack as recited in claim 1, further including means for opening a portion of said channel to enable said belt to be placed therein.

12. The rack as recited in claim 11, wherein means for opening comprises a portion of said channel being removably attached, whereby removing said portion leaves a gap for inserting said belt into said channel.

13. The rack as recited in claim 1, further comprising:

at least one elongated accessory member extending between the pair of opposing base plates, said accessory member having a pair of distal ends engaged in sockets in said belt; and a plurality of space-apart groups of accessory arms extending outwardly of the accessary member for receiving clothing accessories.

14. The rack as recited in claim 13, wherein each said group of accessory arms comprises three L-shaped members that extend radially away from the elongate member.

15. The rack as recited in claim 1, further comprising a C-shaped bracket that engages the pair of base plates and the bracket adapted for mounting to a wall for supporting said rack thereon.

16. An elongate rotatable rack providing readily accessible storage of a plurality of shoes in a clothes closet, comprising:

a pair of opposing base plates, each having a slotted channel extending around the perimeter on respective facing surfaces of the pair of base plates;

said slotted channel defined by a pair of parallel, spaced-apart L-shaped flanges extending from the base plate to define a gap between the distal ends of the flanges;

a flexible belt disposed within each of the slotted channels and each of the belts defining a plurality of substantially equally spaced-apart sockets therein;

a plurality of elongate members extending between the pair of opposing base plates, each of said elongate members engaged at respective distal ends in one of the sockets of each of the belts, the end portions of the elongate members extending through said gap between said flanges defining said slotted channel;

a plurality of spaced-apart cross-arms attached to each of the elongate members;

a pair of shoe receivers attached to each cross-arm, each shoe receiver attached at a first end to a respective distal portion of the cross-arm and at a second end to the elongate member, whereby a shoe, being inverted, is slidingly received on one of said shoe receivers, whereby shoes, being placed on the shoe receivers, are selectively viewed for retrieval by causing the belts to move along the channels.

17. The rack as recited in claim 16, further comprising means for supporting said rack.

18. The rack as recited in claim 17, wherein said support means comprises a plurality of wheels engaging a lower surface of a lower one of said base plates, said wheels for bearing against a floor surface of a clothes closet in order to support the rack therein.

19. The rack as recited in claim 17, wherein said support means comprises a plurality of loops extending from an outer surface of an upper one of said base plates for receiving an elongated rod mounted within a closet space, whereby the shoe rack is suspended from the elongated rod within the closet.

* * * * *